US010066424B2

(12) United States Patent
Fiedler et al.

(10) Patent No.: US 10,066,424 B2
(45) Date of Patent: Sep. 4, 2018

(54) SLIDING DOOR LOCK SYSTEM

(71) Applicant: Hymer GmbH & Co. KG, Bad Waldsee (DE)

(72) Inventors: Andreas Fiedler, Neu-Ulm (DE); Bernhard Sawetzki, Wolfegg (DE)

(73) Assignee: HYMER GMBH & CO. KG, Bad Waldsee (DE)

( * ) Notice: Subject to any disclaimer, the term of this patent is extended or adjusted under 35 U.S.C. 154(b) by 37 days.

(21) Appl. No.: 14/814,117

(22) Filed: Jul. 30, 2015

(65) Prior Publication Data

US 2017/0030115 A1 Feb. 2, 2017

(51) Int. Cl.

| | |
|---|---|
| ***E05C 19/00*** | (2006.01) |
| ***E05B 77/02*** | (2014.01) |
| ***E05B 15/02*** | (2006.01) |
| ***E05B 83/40*** | (2014.01) |
| ***E05B 83/44*** | (2014.01) |

(52) U.S. Cl.

CPC ..... *E05B 77/02* (2013.01); *E05B 15/0205* (2013.01); *E05B 83/40* (2013.01); *E05B 83/44* (2013.01)

(58) Field of Classification Search

CPC ..... E05B 77/02; E05B 15/0205; E05B 83/40; E05B 83/44; B60J 5/06

USPC ..... 292/304, DIG. 46

See application file for complete search history.

(56) References Cited

U.S. PATENT DOCUMENTS 1,861,141 A * 5/1932 Samburg ..... E05B 65/5253 292/153
1,863,032 A * 6/1932 Seelinger ..... E05B 85/24 16/86 A
2,156,874 A * 5/1939 Schonitzer ..... E05B 85/045 16/85
2,243,758 A * 5/1941 Krause ..... E05B 83/24 16/85
2,283,304 A * 5/1942 Williams ..... E02D 29/14 292/212
2,312,892 A * 3/1943 Fisher ..... E05B 15/0205 292/340
2,488,119 A * 11/1949 Ferris ..... E05C 3/041 292/204
3,145,040 A * 8/1964 Phelps ..... A61G 17/02 27/17
3,552,791 A * 1/1971 Watermann ..... E05B 3/367 292/304
3,656,789 A * 4/1972 Ray ..... E05C 19/00 292/205
3,757,384 A * 9/1973 Rusch ..... E05D 15/063 16/223
3,963,269 A * 6/1976 Rosenberg ..... E05B 17/2088 292/304

(Continued)

*Primary Examiner* — Kristina R Fulton
*Assistant Examiner* — Faria F Ahmad
(74) *Attorney, Agent, or Firm* — Cantor Colburn LLP

(57) ABSTRACT

A sliding door lock system comprising a sliding door lock mechanism having a top plate which is fixed to a door frame via two flaps, each comprising a bolt receiving element for fixing the sliding door lock mechanism to the door frame using a fixing element, said top plate being shifted with respect to the door frame so that a cavity is formed, limited by side walls extending between the shifted part of the top plate and the flaps, said sliding door lock system comprising a reinforcement element which is disposed on at least one of the flaps and next to at least one of the side walls, wherein a support wall of the reinforcement element is adapted to support the adjacent side wall of the sliding door lock mechanism so that an outward deformation or a bending can be prevented.

6 Claims, 3 Drawing Sheets

(56) References Cited

U.S. PATENT DOCUMENTS

| | | | | | |
|---|---|---|---|---|---|
| 4,050,725 | A * | 9/1977 | Wilson | E05C 3/34 | 292/304 |
| 4,061,371 | A * | 12/1977 | Prather | E05B 65/006 | 174/38 |
| 4,194,774 | A * | 3/1980 | Kempka | B65F 1/1615 | 292/202 |
| 4,379,576 | A * | 4/1983 | Blough | E05B 67/383 | 292/205 |
| 4,514,996 | A * | 5/1985 | Sjogren | E05B 65/087 | 292/147 |
| 4,530,531 | A * | 7/1985 | Mantini | E05B 67/383 | 292/302 |
| 5,511,833 | A * | 4/1996 | Tashman | E05B 65/08 | 292/102 |
| 6,010,164 | A * | 1/2000 | Yoda | E05B 77/02 | 292/216 |
| 6,367,852 | B1 * | 4/2002 | Aspenwall | E05B 65/0894 | 292/281 |
| 6,837,527 | B1 * | 1/2005 | Laurenzana | E05B 15/0205 | 292/340 |
| 6,857,672 | B1 * | 2/2005 | Drew, II | E05B 15/0205 | 292/340 |
| 7,246,829 | B1 * | 7/2007 | Balsbaugh | E05B 65/0841 | 292/102 |
| 7,510,223 | B2 * | 3/2009 | Malkowski, Jr. | E05B 15/022 | 292/304 |
| 8,813,529 | B2 * | 8/2014 | Donth | E05B 67/383 | 109/51 |
| 2010/0052340 | A1 * | 3/2010 | Thomas | E05C 17/50 | 292/297 |

* cited by examiner

SLIDING DOOR LOCK SYSTEM

FIELD OF THE INVENTION

This invention relates to a sliding door lock system and to a reinforcement element for application at a sliding door lock mechanism.

BACKGROUND OF THE INVENTION

Sliding doors of the kind here concerned are used in vehicles as for example in vans, recreational vehicles, mobile homes, caravans, campers and the like. A sliding door is a type of door mounted on or suspended from a track or rail for the door to slide, usually horizontally. The most common type of sliding door has a three-point suspension and opens outwards, then rides along the side of the vehicle.

Generally, sliding doors are heavy and big. In the case of an accident, big forces act on the whole sliding door lock system and in particular on the sliding door lock mechanism that is adapted to close the sliding door. Common sliding door lock mechanisms are made of sheet metal and can bend or deform due to these forces.

Therefore, the invention provides a sliding door lock system and a reinforcement element for application at a sliding door lock mechanism that supports the sliding door lock mechanism and prevents the structure of the sliding door lock mechanism from deformation or bending.

SUMMARY OF THE INVENTION

According to the invention, there is provided a sliding door lock system, comprising a sliding door lock mechanism having a top plate forming at least two flaps and being fixed to a door frame via the at least two flaps. In a preferred embodiment, the top plate comprises two flaps. Each flap comprises a bolt receiving element—or at least one bolt receiving element—for fixing the sliding door lock mechanism to the door frame using a fixing element. The top plate is shifted with respect to the door frame so that an opening or cavity is formed limited by appropriate side walls that extend between the flaps and the shifted part of the top plate. In some embodiments, the top plate is aligned or linked with the (two) flaps by appropriate sidewalls in such a manner so that the top plate is shifted with respect to the door frame to form the cavity or opening. The sliding door lock system comprises a reinforcement element which is disposed on at least one of the flaps and next to at least one of the sidewalls and which is also fixed by the appropriate fixing element. The support wall of the reinforcement element is adapted to support the adjacent sidewall of the sliding door lock mechanism so that an outward deformation or a bending can be prevented.

There is the risk that the top plate, in particular the opening or cavity, may deform, bend or deflect outwardly due to the forces that may occur during accidents/crashes. The reinforcement element advantageously struts, supports and reinforces the side wall or side walls of the top plate and as a consequence the whole top plate and the door lock mechanism.

The sliding door lock mechanism has a part that is located/positioned at the door frame, as described before, and a part that is located/positioned at the (sliding) door.

The opening or cavity is provided so that the part of the lock mechanism that is arranged at the door can gear into it. Generally, this part comprises a kind of engagement or contact element like a stud or a pin that is adapted to gear with the top plate and/or into the cavity etc. In one embodiment, the top plate may comprise a recess and/or a rotatable clamp. The recess and the clamp are adapted to guide a pin or a stud of the sliding door lock mechanism (attached at the door) for example into the cavity. This mechanism is known from the prior art.

However, the reinforcement element enables now a stabilization of the door lock mechanism that is arranged at the door frame, in particular of its top plate.

In one embodiment, the top plate is made of sheet metal with a thickness of about 1 to 4 mm. According to a preferred embodiment, the top plate is not directly arranged at the door frame. Instead, a ground plate is provided that is positioned between the door frame and the top plate. Therefore, the cavity/opening is formed between the top plate and the ground plate or between the top plate and the door frame if no ground plate is arranged in between. The ground plate is, according to one embodiment, also made of sheet metal with a thickness of about 1 to 4 mm.

Preferably, the support wall of the reinforcement element supports the sidewall of the top plate in such a manner so that an outward deformation or a bending can be prevented as the support wall reinforces or struts the sidewalls.

In one embodiment, the side walls project basically rectangularly with respect to the top plate and the flaps. The middle part of the top plate is shifted with respect to the flaps within a range of about 4 to 8 mm, for example 7 mm.

In one embodiment, a distance or gap between the support wall of the reinforcement element and the adjacent side wall is smaller than about 0.1 mm. However, a distance or gap bigger than 0.1 mm is also possible as long as a sufficient support of the adjacent side wall is provided by the support wall. In one embodiment, the support wall of the reinforcement element and the adjacent sidewalls may also be at least partly in contact.

In one embodiment, the reinforcement element is adapted to support the adjacent sidewall of the sliding door lock mechanism over its entire width. This means that the reinforcement element is in one embodiment as broad or at least as broad as the top plate or its sidewalls, respectively.

In one embodiment, the reinforcement element is formed and disposed in such a manner so that a width of the sliding door lock mechanism is not exceeded by the reinforcement element. However, if operation of the door lock system is not affected, the reinforcement element may also be broader, according to another element.

In one embodiment, a height of the reinforcement element corresponds to an upper surface of the top plate. Preferably, the height of the reinforcement element or its support wall, respectively, is at least as high as the upper surface of the top plate. Similarly to the aforementioned feature, the height of the reinforcement element may also be bigger or smaller if operation of the door lock system is not affected and the support-effect of the reinforcement element is still sufficiently provided.

According to the invention, a reinforcement element is provided for application at the sliding door lock mechanism wherein said reinforcement element comprises a ground wall, a support wall and at least one bolt receiving opening positioned so that the support wall of the reinforcement element can support an adjacent sidewall of the sliding door lock mechanism in such a manner so that an outward deformation or a bending can be prevented.

According to one embodiment, the reinforcement element is a basically rectangular body made of metal, e. g. steel. For example, one of the following US-steel-types may be used: ASTM A 1011 Grade 33 (German equivalent S 235), ASTM A 1012 Grade 40 (German equivalent S 275) or ASTM A 1013 Grade 50 (German equivalent S 355). According to another embodiment, a high-strength plastic-material may be used.

In one embodiment, a width of the reinforcement element is about 20 to 50 mm, e.g. 31 mm, a length is about 8 to 28 mm, e.g. 17 mm and a height is about 4 to 10 mm, e.g. 7 mm. Generally, the size of the reinforcement element depends on the design and the size of the door lock mechanism it is attached to.

According to one embodiment, the at least one bolt receiving opening is a through hole. According to one embodiment, the bolt receiving element may comprise a counterbore. In one embodiment, a diameter of the through hole is about 5 to 8 mm, e.g. 6.5 mm, wherein a diameter of the counterbore is about 9 to 12 mm, e.g. 10.5 mm, with a depth of about 2 to 4 mm, e.g. 3 mm. In one embodiment, the fixing element that is used to fix the reinforcement element and the sliding door lock mechanism to the door frame is for example an Allen screw. Of course, any other type of fixing element is also usable.

It shall be mentioned that the aforementioned dimensions are in particular mentioned by way of example. Generally, the sizes of the reinforcement element depends on the size of the door-lock system.

The ground wall of the reinforcement element is the part of the element that is in contact with the flap of the top plate. According to one embodiment, a region between the ground wall and the support wall is round or rounded, respectively. Expediently, the rounded region enables a perfect positioning of the reinforcement element with respect to the sidewall. Generally, the top plate is a bent sheet metal. Thus, between the flaps and the sidewalls or at the top plates, respectively, small radiuses are performed. The rounded region makes sure that the reinforcement element can be arranged next to the sidewalls without aborting the rounded edges of the region between the sidewalls and the flaps. In one embodiment a radius between the side wall and the ground wall is about 1 to 5 mm, preferably 3 mm.

According to one embodiment, the ground wall comprises a recess or at least one recess, respectively, The recess(es) may be formed as opening or hole being adapted to arrange another element into it, e.g. a screw head which is already mounted. This enables a very flexible arrangement of the reinforcement element. According to one embodiment, the reinforcement element comprises an anti-twist device. The anti-twist device may by an opening or hole which is adapted to arrange a pin or the like into it. The aforementioned openings or holes may for example be milled.

BRIEF DESCRIPTION OF DRAWING FIGURES

Figure 4A:
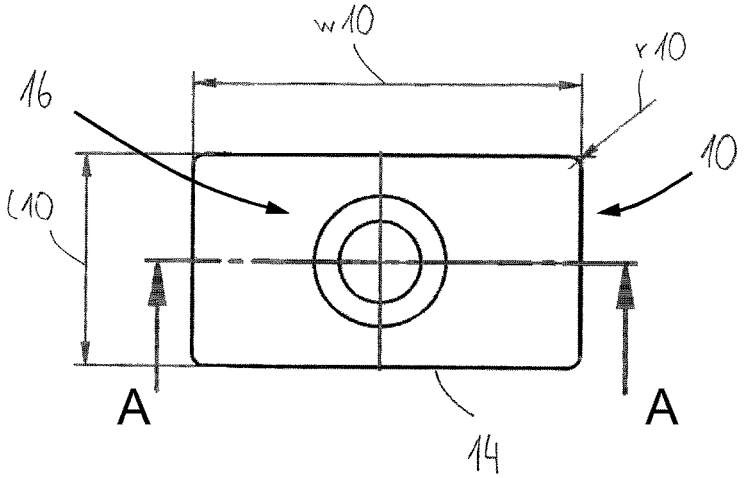

FIG. 4*a* is a top view of a reinforcement element.

Figure 4B:
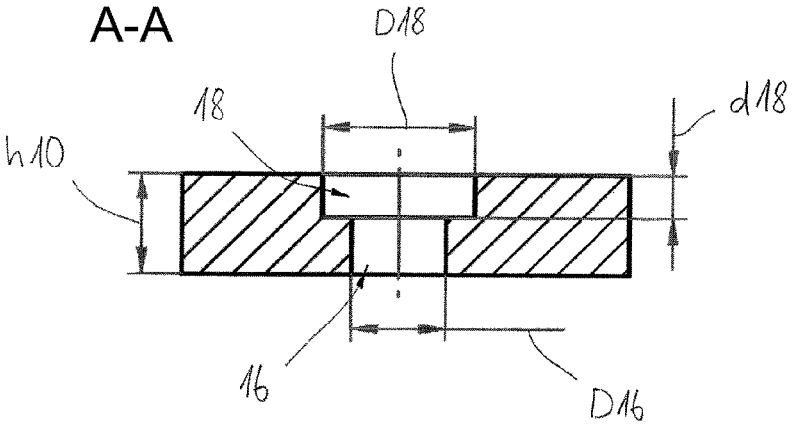

FIG. 4*b* is a sectional view of the reinforcement element of FIG. 4*a*.

Figure 4C:
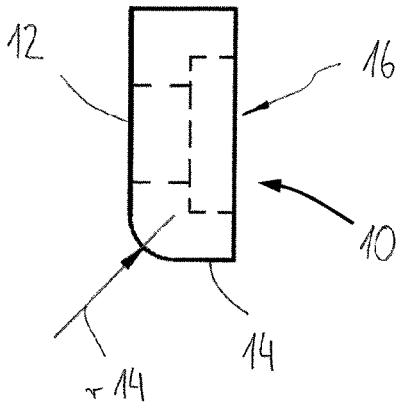

FIG. 4*c* is a side view of the reinforcement element of FIG. 4*a*.

DETAILED DESCRIPTION

As required, detailed embodiments of the present invention are disclosed herein; however, it is to be understood that the disclosed embodiments are merely exemplary for the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
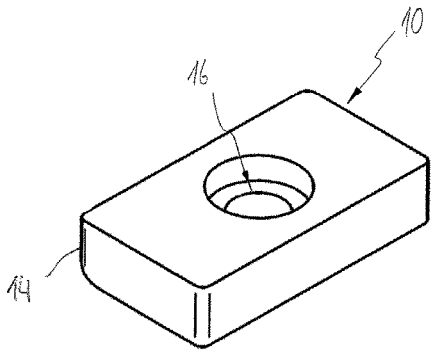
FIG. 1 is a perspective view of a reinforcement element.

With reference to FIG. 1, a perspective view of a reinforcement element 10 is shown. The reinforcement element 10 comprises a bolt receiving opening 16 that is positioned basically in the middle of the reinforcement element 10. The reinforcement element 10 has a basically rectangular body, according to a preferred embodiment made of steel. One of the outer walls of the reinforcement element 10 is a support wall 14 that is adapted to support an adjacent sidewall of a sliding door lock mechanism (not shown).

Figure 2:
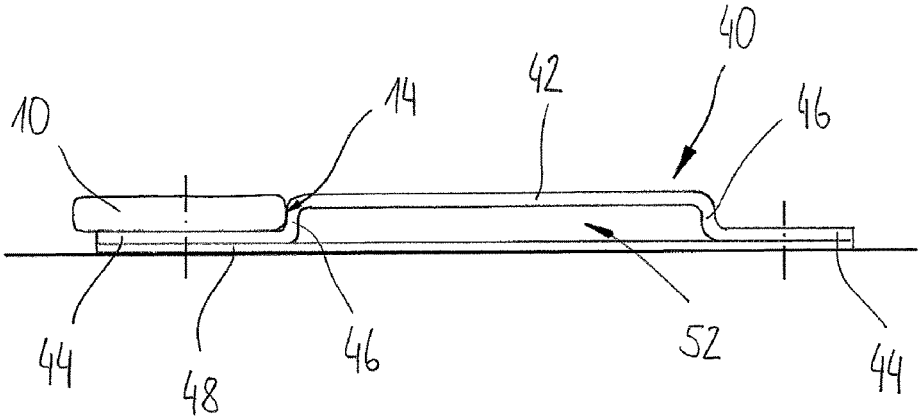
FIG. 2 is a side view of a reinforcement element disposed at a sliding door lock mechanism.

FIG. 2 shows—in a side view—a reinforcement element 10 that is disposed at a sliding door lock mechanism 40. The sliding door lock mechanism 40 comprises a top plate 42 that has or forms two flaps 44. The flaps 44 are attached to a ground plate 48 and the top plate 42 and the ground plate 48 are fixed by appropriate fixing elements to a door frame (not shown). The top plate 42 as well as the ground plate 48 are in one embodiment for example made of sheet metal. That means that the top plate 42 is for example bended to form the flaps 44. At the left flap 44, the reinforcement element 10 is disposed in such a manner so that a support wall 14 of the reinforcement element 10 is in contact or nearly in contact with a sidewall 46 of the top plate 42. Between the top plate 42 and the ground plate 48, a cavity/opening 52 is formed that is for example adapted to receive a stud or a pin of a sliding door lock mechanism of the appropriate (sliding) door of the vehicle. It may be understood that the top plate 42 or its side walls 46 may bend or deform outwardly if something is guided or put into the cavity 52. Preferably, the reinforcement element 10 is disposed on at least one of the flaps 44 to enhance and reinforce the whole structure, in particular the side walls 46.

Figure 3:
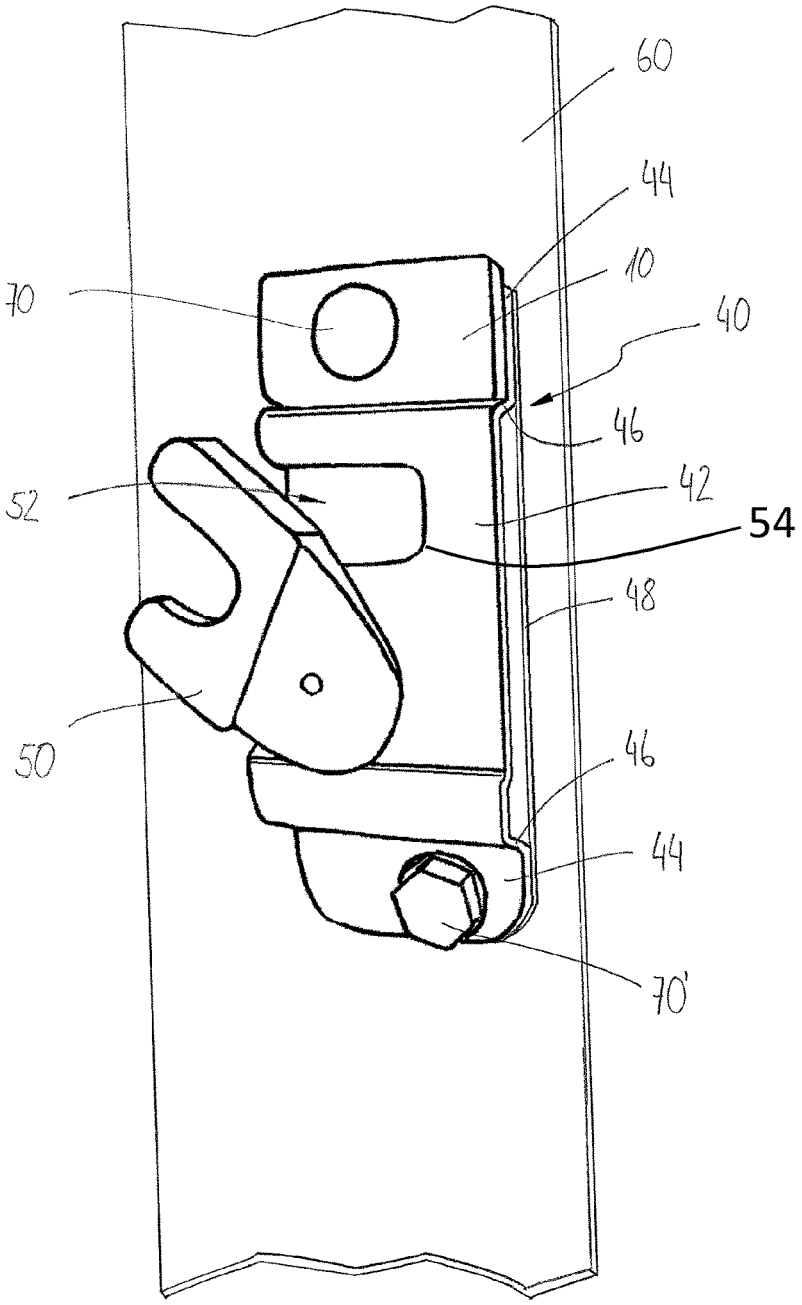
FIG. 3 is a perspective view of a reinforcement element disposed at a sliding door lock mechanism that is attached to a door frame.

FIG. 3 shows a sliding door lock mechanism 40 that is attached to a door frame 60. As already known, the sliding door lock mechanism 40 comprises a top plate 42 and a ground plate 48. The top plate 42 comprises two flaps 44 and is shifted with respect to the ground plate 48 so that a cavity/an opening 52 is formed between the top plate 42 and the ground plate 48. The top plate 42 comprises also a recess 54 and a clamp 50 that is rotatably attached to the top plate 42. Advantageously, a reinforcement element 10 is disposed on at least one or both of the flaps 44. In the embodiment shown in FIG. 3, the reinforcement element 10 is positioned/arranged at the upper flap 44. The reinforcement element 10 and the sliding door lock mechanism 40 are fixed by appropriate fixing elements 70, 70' which are for example bolts, screws, or the like. The fixing element 10 that is used to fix the reinforcement element 10 is preferably an Allen screw, also called hexagon socket screw. Of course, torx screws or the like may also be used.

FIG. 4*a* shows a top view of a reinforcement element 10. The outer edges of the reinforcement element 10 have a radius r10 which is for example 1 mm. A bolt receiving opening 16 is in this embodiment positioned basically in the middle of the reinforcement element 10. The reinforcement element 10 has a basically rectangular form with a width w10 and a length l10. In one embodiment, the width w10 is about 31 mm, the length l10 about 17 mm. A section view A-A is shown in FIG. 4*b*.

FIG. 4*b* shows the section view A-A of FIG. 4*a*. The reinforcement element 10 has a height h10. In one embodiment, the height h10 is about 7 mm. The bolt receiving opening 16 is formed as a through hole 16 and comprises a counterbore 18 with a depth d18 which is, according to one embodiment, about 3 mm. A diameter of the counterbore 18 is referenced by reference numeral D18 and a diameter of the through hole 16 is referenced by reference numeral D16. In one embodiment, the diameter D16 is about 6.5 mm, wherein the diameter D18 is about 10.5 mm.

FIG. 4*c* shows a side view of the reinforcement element 10 of FIG. 4*a*. This view shows the rounded region between a ground wall 12 and the support wall 14. A radius r14 lies for example within a range of about 3 mm.

What is claimed is:

1. A sliding door lock system of a vehicle comprising a first part located at a door frame; comprising:

a sliding door lock mechanism having a top plate bended to form two flaps attached to a ground plate and the top plate, and the top plate is fixed to the door frame via the two flaps, each comprising a bolt receiving element for fixing the sliding door lock mechanism to the door frame using a fixing element, said top plate being shifted with respect to the door frame so that a cavity is formed between the top plate and the ground plate, limited by side walls extending between the shifted part of the top plate and the flaps;

said sliding door lock system comprising a reinforcement element which is disposed on at least one of the flaps in such a manner that a support wall of the reinforcement element is in contact with a side wall of the top plate and next to at least one of the side walls, wherein a support wall of the reinforcement element is adapted to support the adjacent side wall of the sliding door lock mechanism so that an outward deformation or a bending can be prevented.

2. System according to claim 1, wherein the side walls project rectangularly with respect to the top plate and the flaps.

3. System according to claim 1, wherein a distance between the support wall of the reinforcement element and the adjacent side wall is smaller than about 0.1 mm.

4. System according to claim 1, wherein the reinforcement element is adapted to support the adjacent side wall of the sliding door lock mechanism over its entire length.

5. System according to claim 1, wherein the reinforcement element is disposed in such a manner so that a width of the sliding door lock mechanism is not exceeded by the reinforcement element.

6. System according to claim 1, wherein a height of the reinforcement element corresponds to an upper surface of the top plate.

* * * * *